United States Patent [19]

Weiler et al.

[11] 4,207,990

[45] Jun. 17, 1980

[54] HERMETICALLY SEALED CONTAINER WITH PLURAL ACCESS PORTS

[75] Inventors: Gerhard H. Weiler, South Barrington; Louis T. Pagels, Hanover Park, both of Ill.

[73] Assignee: Automatic Liquid Packaging, Inc., Arlington Heights, Ill.

[21] Appl. No.: 35,626

[22] Filed: May 3, 1979

[51] Int. Cl.[2] ..... B65D 41/32

[52] U.S. Cl. ..... 220/267; 220/266; 220/277; 215/1 C; 215/32; 222/81; 222/541

[58] Field of Search ..... 220/265–267, 220/276, 277; 215/32, 1 C; 222/81, 541, 525; 150/0.5

[56] References Cited

U.S. PATENT DOCUMENTS

| | | | |
|---|---|---|---|
| 3,356,244 | 12/1967 | Witchell | 215/32 |
| 3,385,461 | 5/1968 | Mallin | 215/32 |
| 3,784,045 | 1/1974 | Komendowski | 220/267 X |
| 3,994,412 | 11/1976 | DiFiglio | 220/266 |

*Primary Examiner*—George T. Hall

*Attorney, Agent, or Firm*—Dressler, Goldsmith, Shore, Sutker & Milnamow, Ltd.

[57] ABSTRACT

A hermetically sealed container with plural access ports is provided. The closure includes a severable dome unitary with the container and positioned over the container access opening. The dome is severable from the container by the action of a collar threadedly attached to the container. The dome is further provided with an access aperture that is closed off by a twist-off cap which, upon removal, exposes the dispensing aperture.

7 Claims, 5 Drawing Figures

14
24
15
10
13
11
16
17
12

33
34
36
35
30
14
26
27
28
37
22
23
24
15
20
21
13

34
35
31
30
29
14
27
28
37
25
24
32
23
15
13
20
21

24
14
15
34
11
35
10

12
18
16
19

HERMETICALLY SEALED CONTAINER WITH PLURAL ACCESS PORTS

TECHNICAL FIELD

This invention relates to a hermetically sealed container having a unitary closure providing plural access ports.

BACKGROUND OF THE INVENTION

Hermetically sealed containers with unitary closures are known in the art. Generally such containers are made using the apparatus and the form, fill, and seal techniques disclosed in U.S. Pat. No. Re. 27,155 to Hansen and in U.S. Pat. No. 3,597,793 to Weiler et al. Typical such containers are of unitary construction and are provided with a closure that can be severed with a knife or twisted off. Containers of this general type are very well suited for sterile and aseptic packaging of parenteral solutions and the like.

Recently a demand has developed for containers for pharmacological and/or veterinary solutions that are suitable not only for parenteral administration but also for oral administration as well. To this end it would be desirable to have a container that is well suited for the dispensing of the container contents by whatever route the physician or the veterinarian deems to be the most expedient at any given time. The containers embodying the present invention satisfy this demand.

SUMMARY OF THE INVENTION

The present invention includes a hermetically sealed container of unitary construction and provided with plural access ports that provide an option as to the route of administration for the container contents.

A container embodying the present invention has a hollow body portion, a neck portion unitary with the body portion and defining a container access opening, and a unitary closure means for said access opening but providing a plurality of access ports. The closure means includes a dome means positioned over the container access opening and connected thereto by means of a severable annular web which is rupturable to rapidly dispense the container contents, e.g., for oral administration. Unitary with the dome means is a hollow stem that surrounds a dispensing aperture provided in the dome means and is adapted to receive a draining spike or similar implement for use when it is desired to dispense the container contents over an extended period of time, e.g., for administration of the container contents by infusion.

In particular, the dome means extends over the access opening in the container neck portion and is provided with a draining aperture and with a peripheral flange that serves to rigidify the dome means. Preferably, the draining aperture is located at the apex of the dome means.

An upstanding hollow stem, unitary with the dome means, surrounds the draining aperture. The hollow stem is dimensioned so as to receive, and preferably hold therewithin in a liquid-tight engagement, a draining spike. The distal end of the hollow stem, and thus the draining aperture, is closed off by a twist-off cap connected thereto by a frangible web that is unitary with the cap and the stem.

The dome means is joined to the container neck portion which defines the container access opening by a severable but unitary annular web that depends from the dome means. The annular web is spaced inwardly from the periphery of the dome means and defines an undercut that guides the cutting means for detaching the dome means from the container when desired. As the dome means is detached, the aforementioned upstanding hollow stem together with the twist-off cap associated therewith provides a handle means for lifting the detached dome means from the container.

For convenient detachment of the dome means a collar threaded onto external threads on the container neck portion is provided. A plurality of inwardly projecting, flexible blade members on the collar snappingly engage the underside of the peripheral flange of the dome means within the aforementioned undercut as the collar is screwed onto the neck portion. As the collar is unscrewed, these blade members abut the peripheral flange on the dome means, are urged further inwardly, and cut the severable annular web.

BRIEF DESCRIPTION OF THE DRAWING

In the accompanying drawing forming part of the specification, and in which like numerals are used to designate like parts throughout the same.

DESCRIPTION OF PREFERRED EMBODIMENTS

Figure 1:
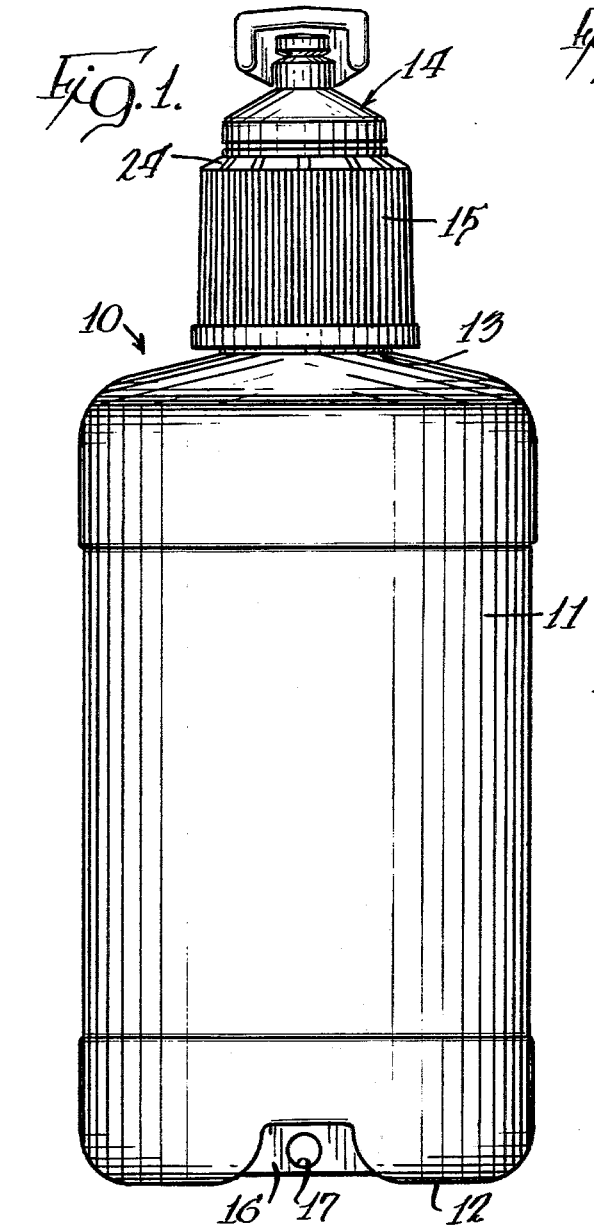
FIG. 1 is a front elevational view of a container embodying the present invention.

The invention disclosed herein is, of course, susceptible of embodiment in many different forms. Shown in the drawing and described hereinbelow in detail are certain preferred embodiments of the present invention. It is to be understood, however, that the present disclosure is an exemplification of the principles of this invention and does not limit the invention to the illustrated embodiments.

For ease of description, the containers of this invention will be described in their usual position when at rest as shown in the accompanying drawing, and terms such as upper, lower, horizontal, etc. will be used herein with reference to this usual position. However, the containers embodying this invention may be manufactured, stored, transport, sold, or used in an orientation other than that described and shown herein.

The apparatus as well as the manufacturing expedients taught in the aforementioned U.S. Pat. Nos. Re. 27,155 and No. 3,597,793 can be readily utilized to manufacture the present containers. However, while economic advantages are readily realized by the automatic forming, filling and hermetic sealing as taught in the foregoing patents, containers embodying the present invention can also be formed first and then filled in a separate operation, if desired.

Generally, apparatus for forming, filling, and hermetically sealing the containers includes a parison extruder, a two-piece container body mold having a pair of movable, complementary mold halves, parison holding jaws, a two-piece container closure mold having a pair of movable, complementary mold halves, a parison cutting device, and a filling mandrel that can also include a blowing tube for forming the container body. In the alternative, the container can also be formed by drawing a vacuum through the container body mold halves. To form a container having the desired configuration, as determined by the mold cavities, a parison in the form of a hollow tube having a predetermined length is extruded between the mold halves. The mold halves are then closed, pinching shut the bottom of the extruded tube. The upper portion of the extruded tube is grasped by the holding jaw, usually by application of vacuum, and the tube length enveloped by the mold assembly is severed above the holding jaws using the cutting device. Thereafter a mold carriage moves the mold assembly away from under the extruder and into position for forming, filling and sealing of the container.

To form and fill the container, the mandrel is positioned within the severed parison segment which is then expanded to conform to the body mold cavity by differential air pressure while a metered quantity of the desired container contents is introduced therewithin. The thus formed body portion of the container usually is chilled to solid state by contact with the mold as well as by the introduced contents.

Thereafter the mandrel is elevated and the container closure mold halves are brought together to hermetically seal the container. Upon completion of the sealing operation the mold halves and the holding jaws are opened and the formed, filled and sealed container leaves the apparatus by way of a dropout chute positioned below the apparatus.

To fabricate the present containers the conventional thermoplastic molding materials such as polyethylene (low and high density), polypropylene, polycarbonate, acetate, and the like materials compatible with the container contents can be used.

Figure 2:
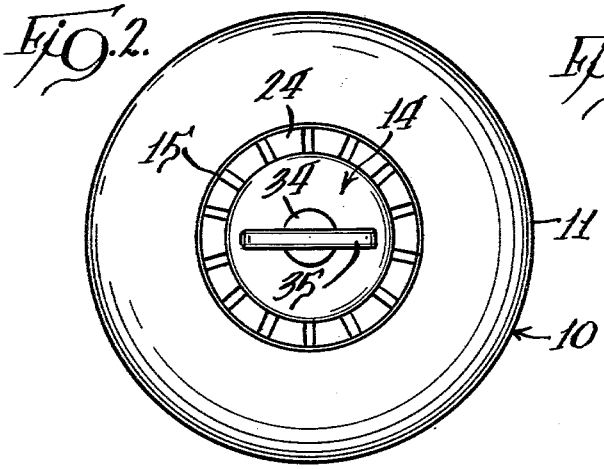
FIG. 2 is a top view of the container shown in FIG. 1.
Figure 3:
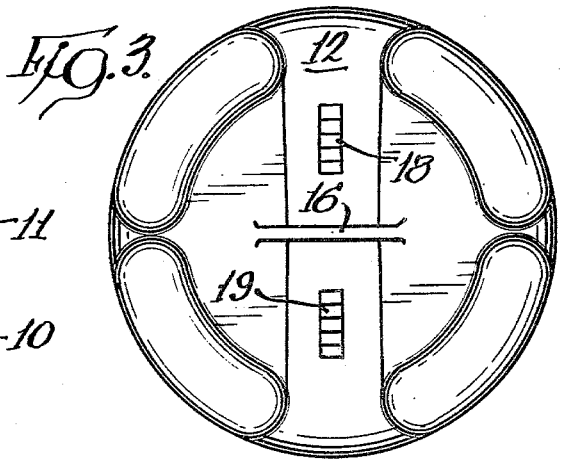
FIG. 3 is a bottom view of the container shown in FIG. 1.

Referring to the drawing, container 10 embodying the present invention is shown in FIGS. 1–3. Container 10 includes hollow body portion 11 having bottom 12 terminating into unitary neck portion 13, and container closure means 14. Collar 15 surrounds neck portion 13. Hanger 16 for upside down suspension of container 10 during infusion of the container contents is unitary with container bottom 12 and is provided with through aperture 17. If desired, lands 18 and 19 can be provided on bottom 12 for product identification codes, lot numbers, and similar purposes.

External threads 20 (FIG. 4) are provided on the lateral surface of neck portion 13 for engagement with internal threads 21 on the inside of collar 15. Additionally, it is preferred that the distal end of neck portion 13, defining container access opening 22, has an outwardly-extending, circumferential flange 23 that enhances the rigidity of neck portion 13 as well as the dimensional stability of access opening 22.

Collar 15 at the upper rim thereof terminates in a plurality of flexible blade members 24 that project inwardly, i.e., toward the longitudinal rotational axis of collar 15 as it is rotated about neck portion 13. Blade members 24 are unitary with collar 15 and serve to sever closure means 14 from container 10 so as to provide full access to opening 22 as will be discussed in greater detail hereinbelow. Collar 15 can be fabricated from a wide variety of materials such as polyolefin, polystyrene and the like. A convenient way of making collar 15 is by injection molding of the above materials.

Closure means 14 comprises several coacting elements and is connected to neck portion 13 by means of severable annular web 25 (FIGS. 4 and 5) that is unitary with dome 26 as well as with the distal end of neck portion 13 when container 10 is hermetically sealed. The thickness of web 25 is selected so that it can be readily cut by blades 24 yet so that the integrity of sealed container 10 can be maintained during normal handling. Web 25 depends from dome 26 and is spaced inwardly from the periphery thereof so as to provide an undercut within which blades 24 can be received as shown in FIG. 5.

Dome 26 is provided with unitary peripheral flange 27 to provide a rigid abutment for blades 24 as collar 15 is unscrewed so as to open container 10. Rigidity of flange 27 can be further enhanced, if desired, by providing therein circumferential groove 28. Additionally, dome 26 defines draining aperture 29 that can be utilized to withdraw the container contents without severing dome 26 from container 10. For this purpose hollow stem 30, unitary with dome 26, surrounds aperture 29, and provides a receptacle for a draining spike or similar implement. The internal dimensions of channel 31 in hollow stem 30 are selected so as to receive and hold the draining spike in a liquid-tight engagement when container 10 is inverted. Preferably draining aperture 29, and thus hollow stem 30, are situated at the apex of dome 29.

Structural rigidity of closure means 14 is desirable when a draining spike is received within channel 31. To this end the tips of blades 24 in contact with web 25, which is relatively thin compared to adjacent flanges 23 and 27, provide reinforcement. The downwardly flexing of blades 24 during insertion of the draining spike is prevented by flange 23 and, in particular, by the outwardly beveled surface 32 of flange 23.

Channel 31 and aperture 29 are closed off by twist-off cap 33 which includes cap body portion 34 and outwardly extending tab 35. Twist-off cap 33 is unitary with hollow stem 30 and thus also with container 10. Cap body portion 34 is connected to hollow stem 30 by frangible web 36 that can be readily broken by twisting cap body portion 34 relative to stem 30. The fabrication of suitable frangible webs is taught in commonly owned U.S. Pat. Nos. 3,597,793 and 4,055,282. The disclosure of these two patents is incorporated herein by reference to the extent pertinent.

Figure 4:
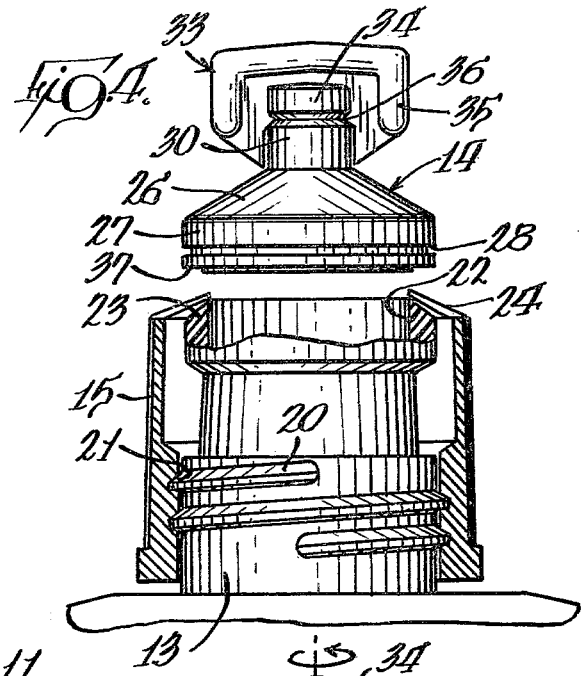
FIG. 4 is an enlarged, fragmentary side elevational view of a container embodying the present invention, shown with the larger of two access ports open, partially in section and with portions broken away to show interior detail.
Figure 5:
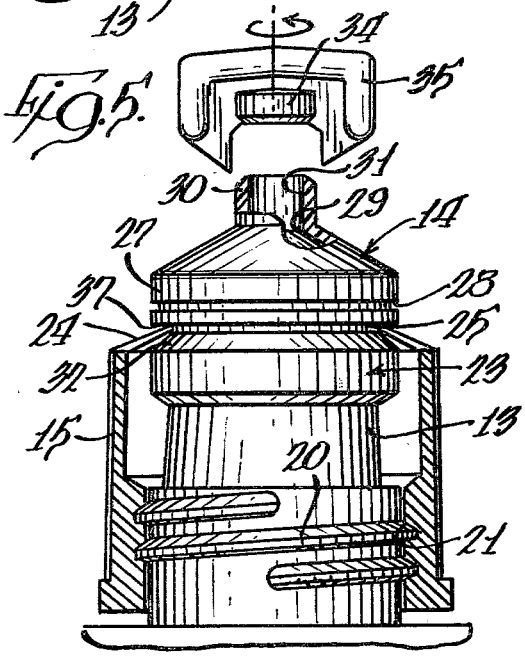
FIG. 5 is an enlarged, fragmentary side elevational view of a container embodying the present invention, shown with the smaller of two access ports open, partially in section and with portions broken away to show interior detail.

Twist-off cap 33 closing off channel 31 in hollow stem 30 is shown in FIG. 4. Moreover, as can be seen from this particular Figure, cap 33 as well as stem 30 also provide a convenient handle means for lifting off closure means 14 after it has been severed by blades 24 or any other convenient cutting means acting on web 25.

Collar 15 is placed on formed, filled and sealed container 10 by threadedly engaging internal threads 21 with external threads 20 on neck portion 13. As collar 15 is screwed down, blades 24 ride over peripheral flange 27 and snappingly engage severable web 25. To remove the entire closure means 14 from container 10, collar 15 is unscrewed. As collar 15 is elevated with respect to container neck portion 13 during the unscrewing manipulation, blades 24 first abut against underside 37 of flange 27. Upon further elevation of collar 15 blades 24 are deflected inwardly so as to incise web 25 while at the same time exerting an upwardly lifting force around the periphery of flange 27. Continued elevation of collar 15 results in complete removal of closure means 14 from neck portion 13, thereby exposing access opening 22.

On the other hand, when it is desired to prepare container 10 so as to receive a draining spike for a gradual withdrawal of container contents, channel 31 and aperture 29 are exposed by merely twisting off cap 33.

The foregoing specification and drawing are intended as illustrative, and are not to be taken as limiting. Still other variations, modifications and rearrangements of parts are possible without departing from the spirit and scope of the present invention.

We claim:

1. A hermetically sealed container having a hollow body portion, a neck portion unitary with the body portion and defining a container access opening, and a closure means for said access opening but providing plural access ports, which closure means comprises:

a dome means over said access opening, defining a draining aperture and having a peripheral flange;

an upstanding hollow stem around said draining aperture and unitary with said dome means, said hollow stem being dimensioned to receive therewithin a draining spike;

a twist-off cap at the distal end of said hollow stem, connected thereto by a frangible web unitary with the cap and the stem, and covering the draining aperture; and a severable annular web depending from said dome means, unitary therewith and with the distal end of the neck portion, and spaced inwardly from the periphery of the dome means.

2. The hermetically sealed container in accordance with claim 1 wherein the neck portion is provided with external threads around the lateral surface thereof and wherein an internally-threaded collar is threadedly engaging the neck portion; said collar having a plurality of inwardly projecting, flexible blade members snappingly engaging said severable annular web.

3. The hermetically sealed container in accordance with claim 1 wherein said twist-off cap includes a cap body portion and tab means extending outwardly therefrom.

4. The hermetically sealed container in accordance with claim 1 wherein the peripheral flange of said dome means is provided with a circumferential groove enhancing rigidity of the flange.

5. The hermetically sealed container in accordance with claim 1 wherein the distal end of the neck portion terminates in a circumferential, outwardly-extending flange.

6. The hermetically sealed container in accordance with claim 1 further provided with a unitary hanger means at the bottom thereof.

7. The hermetically sealed container in accordance with claim 1 wherein said draining aperture in the dome means is situated at the apex of the dome means.

* * * * *